US012540777B2

(12) United States Patent
Yeh et al.

(10) Patent No.: US 12,540,777 B2
(45) Date of Patent: Feb. 3, 2026

(54) THERMOSYPHON COOLING DEVICE WITH UPRIGHT ROLL-BOND FINS

(71) Applicant: DELTA ELECTRONICS, INC., Taoyuan (TW)

(72) Inventors: Cheng-Tang Yeh, Taoyuan (TW); Li-Kuang Tan, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 188 days.

(21) Appl. No.: 18/378,859

(22) Filed: Oct. 11, 2023

(65) Prior Publication Data

US 2024/0310127 A1 Sep. 19, 2024

(30) Foreign Application Priority Data

Mar. 16, 2023 (CN) ..... 202310254051.6

(51) Int. Cl.
*F28D 15/02* (2006.01)

(52) U.S. Cl.
CPC ..... *F28D 15/0266* (2013.01); *F28D 15/0275* (2013.01)

(58) Field of Classification Search
CPC ..... F28D 15/0266; F28D 15/0275; F28D 15/046; F28D 2015/0216
See application file for complete search history.

(56) References Cited

U.S. PATENT DOCUMENTS 4,833,567 A * 5/1989 Saaski ..... F28D 15/046 165/104.33
5,761,037 A * 6/1998 Anderson ..... F28D 15/0266 165/80.4
5,998,863 A * 12/1999 Kobayashi ..... F28F 3/12 361/699
6,005,772 A * 12/1999 Terao ..... F28D 15/0266 165/80.4

(Continued)

FOREIGN PATENT DOCUMENTS

CN 113776369 A 12/2021
TW M619753 U 11/2021
TW 202217216 A 5/2022

*Primary Examiner* — Travis Ruby
(74) *Attorney, Agent, or Firm* — HDLS IPR SERVICES; Chun-Ming Shih

(57) ABSTRACT

The disclosure is directed to a thermosyphon cooling device having a heat-exchange plate and a plurality of roll-bond fins. An evaporation chamber is defined inside the heat-exchange plate. A heat-exchange surface and a top surface are disposed at two sides of the heat-exchange plate. A capillary structure is arranged in the evaporation chamber, and the capillary structure is corresponding to the heat-exchange surface. The roll-bond fins are arranged upright on the top surface, and a plurality of condensing chambers communicating with the evaporation chamber are defined in each of the roll-bond fins, respectively. Each of the condensing chambers communicates with each of the evaporation chambers through at least one overflow port, respectively, and a working fluid is contained in the condensing chambers. Each of the condensing chambers is extended (Continued)

across the at least one overflow port in a direction perpendicular to a normal line of the heat-exchange plate.

16 Claims, 12 Drawing Sheets

(56) References Cited

U.S. PATENT DOCUMENTS 6,341,645 B1 * 1/2002 Tanaka ..... F25B 23/006 165/104.21
6,341,646 B1 * 1/2002 Tanaka ..... F28D 15/0266 165/104.21
6,357,517 B1 * 3/2002 Osakabe ..... F28D 15/0233 165/104.21
6,360,814 B1 * 3/2002 Tanaka ..... H05K 7/20681 361/699
6,437,437 B1 * 8/2002 Zuo ..... H01L 23/427 257/710
6,889,756 B1 * 5/2005 Hou ..... H01L 23/427 174/15.2
9,074,823 B2 * 7/2015 Chang ..... F28F 3/048
10,638,639 B1 * 4/2020 Garner ..... F28D 15/0266
2003/0079863 A1 * 5/2003 Sugito ..... H05K 7/1418 257/E23.098
2004/0011511 A1 * 1/2004 Ghosh ..... F28D 15/0266 257/E23.099
2004/0211549 A1 * 10/2004 Garner ..... F28D 15/046 431/325
2005/0022976 A1 * 2/2005 Rosenfeld ..... F28D 15/046 165/104.11
2005/0056403 A1 * 3/2005 Norlin ..... H01L 23/427 165/104.33
2005/0183847 A1 * 8/2005 Wong ..... F28D 15/0233 165/104.33
2005/0274496 A1 * 12/2005 Ishii ..... F28D 15/046 257/E23.088
2006/0169439 A1 * 8/2006 Hong ..... F28D 15/046 165/104.26
2007/0284088 A1 * 12/2007 Chun ..... F28D 15/046 165/104.21
2008/0196865 A1 * 8/2008 Miyagawa ..... F28D 15/043 165/104.21
2013/0083482 A1 * 4/2013 Uchida ..... F28D 15/046 165/104.26
2013/0160974 A1 * 6/2013 Uchida ..... F28D 15/0266 165/104.21
2013/0340978 A1 * 12/2013 Agostini ..... H05K 7/20309 165/104.21
2014/0166244 A1 * 6/2014 Dai ..... F28D 15/0233 29/890.032
2017/0023308 A1 * 1/2017 Huang ..... F28F 3/00
2017/0049006 A1 * 2/2017 Mclaughlin ..... H01L 23/3672
2019/0132992 A1 * 5/2019 Farshchian ..... H01L 23/427
2019/0353430 A1 * 11/2019 Narasimhan ..... F28D 15/0266
2020/0232717 A1 * 7/2020 Kao ..... F28F 3/06
2021/0215433 A1 * 7/2021 Takabayashi ..... H01L 23/3672
2022/0128316 A1 4/2022 Wen et al.
2022/0205723 A1 * 6/2022 Chen ..... F28D 1/0316
2023/0098311 A1 * 3/2023 Chen ..... F28D 15/043 165/104.26
2023/0106794 A1 * 4/2023 Kawabata ..... F28D 15/0233 165/104.34
2023/0363112 A1 * 11/2023 Pokharna ..... F28D 15/0275

* cited by examiner

THERMOSYPHON COOLING DEVICE WITH UPRIGHT ROLL-BOND FINS

BACKGROUND OF THE DISCLOSURE

Technical Field

This disclosure is directed to a thermosyphon cooling device, and in particular to a thermosyphon cooling device suitable for vertical or horizontal operating status.

Description of Related Art

A related-art thermosyphon cooling device has roll-bond fins, the roll-bond fin has a chamber therein, the thermosyphon cooling device is filled with a low boil point fluid in the chamber. The thermosyphon cooling device is in contact with a heat source via a heat contacting surface thereof. The fluid is vaporized when the fluid flows to the heat contacting surface, and flows upward to an upper portion in the roll-bond fin. The vaporized fluid is condensed via air convection to the roll-bond fin and changed to liquid phase, then the liquid fluid flows back to a lower portion.

In order to maintain a vaporization efficiency of the fluid, it is necessary to accurately define the liquid fluid in thermosyphon cooling device with a specific percentage of volume occupation. If the liquid fluid occupies too much volume, the liquid fluid should be heated for a longer time for vaporizing so that the thermosyphon cooling device has a poor internal heat transfer efficiency. An insufficient volume occupation of the liquid fluid leads to a drying out of the liquid fluid and a failure of condensing so that heat cannot be absorbed by the thermosyphon cooling device because of a failure of internal heat transfer.

The liquid fluid in the thermosyphon cooling device has different levels in different status, such as vertical (standing) or horizontal status, so that the related-art thermosyphon cooling device is suitable for only a specific predetermined installation status.

In view of the above drawbacks, the inventor proposes this disclosure based on his expert knowledge and elaborate researches in order to solve the problems of related art.

SUMMARY OF THE DISCLOSURE

This disclosure is directed to a thermosyphon cooling device suitable for vertical or horizontal operating status.

This disclosure is directed to a thermosyphon cooling device having a heat-exchange plate and a plurality of roll-bond fins. The heat-exchange plate has an evaporation chamber defined therein, a heat-exchange surface, a top surface opposite to the heat-exchange surface, and a capillary structure attached on an inner surface of the evaporation chamber, and the capillary structure is arranged corresponding to the heat-exchange surface. The roll-bond fins are upright arranged on the top surface of the heat-exchange plate. A condensing chamber communicating with the evaporation chamber is defined in each of the roll-bond fins, and each of the condensing chambers communicates with the evaporation chamber through at least one overflow opening. A working fluid is filled in each condensing chamber. Each of the condensing chambers is extended along a direction of a normal line of the heat-exchange plate to be overlapped with a projection of the at least one overflow opening, and each of the condensing chambers is extended along a direction perpendicular to the normal line to cross the at least one overflow opening.

One of the exemplary embodiments, the heat-exchange plate has a base case and a top cover closing the base case. The heat-exchange surface is disposed on the base case, and the top surface is disposed on the top cover.

One of the exemplary embodiments, a plurality of partitions is arranged in the base case, and each of the partitions is connected to the base case and the top cover, respectively. A gap is defined between each of the partitions and an internal surface of the base case. The capillary structure has a plurality of through openings corresponding to the partitions, and the capillary structure is penetrated by the partitions through the through openings correspondingly and respectively.

One of the exemplary embodiments, the top cover has a plurality of insertion holes, and the roll-bond fins are inserted in the insertion holes, respectively. Each of the roll-bond fins has a coupling tube, the coupling tube communicates with the condensing chamber of the roll-bond fin, and the coupling tubes of the roll-bond fins are inserted into the insertion holes, respectively. In each of the roll-bond fins, the overflow opening is formed in the coupling tube of the roll-bond fin.

One of the exemplary embodiments, the capillary structure is arranged in the base case. A plurality of inner fins is arranged in the base case, and the inner fins are disposed between the overflow openings and the capillary structure.

One of the exemplary embodiments, at least one gap is defined between each of the partitions and an internal surface of the base case. The inner fins are disposed parallelly to a normal line of the heat-exchange plate.

One of the exemplary embodiments, the capillary structure has a substrate, a plurality of micro fins is upright arranged on a surface of the substrate, the micro fins are disposed closely at intervals so as to from a plurality of capillary grooves, and each of the capillary grooves is disposed between two of the micro fins adjacent to each other. The capillary grooves are disposed between the substrate and a bottom of the base case. A plurality of inner fins is arranged in the base case, and the inner fins and the capillary groove are disposed on two surfaces of the substrate opposite to each other.

According to the thermosyphon cooling device of this disclosure, most of the working fluid in liquid phase is stored in a portion of the condensing chamber below the overflow opening. With this arrangement, an appropriate amount of working fluid keeps overflowing into the evaporation chamber to cover the portion of the inner wall of the base case corresponding to the heat-exchange surface, thereby preventing the working fluid in this portion from a low evaporation efficiency caused by being submerged in a deep level of the working fluid. Furthermore, drying out caused by an insufficient covering of the working fluid in an operation of vertical status may be prevented by the capillary structure. Accordingly, the thermosyphon cooling device of this disclosure is suitable for vertical or horizontal operating status.

BRIEF DESCRIPTION OF THE DRAWINGS

The features of the disclosure believed to be novel are set forth with particularity in the appended claims. The disclosure itself, however, may be best understood by reference to the following detailed description of the disclosure, which describes a number of exemplary embodiments of the disclosure, taken in conjunction with the accompanying drawings, in which:

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
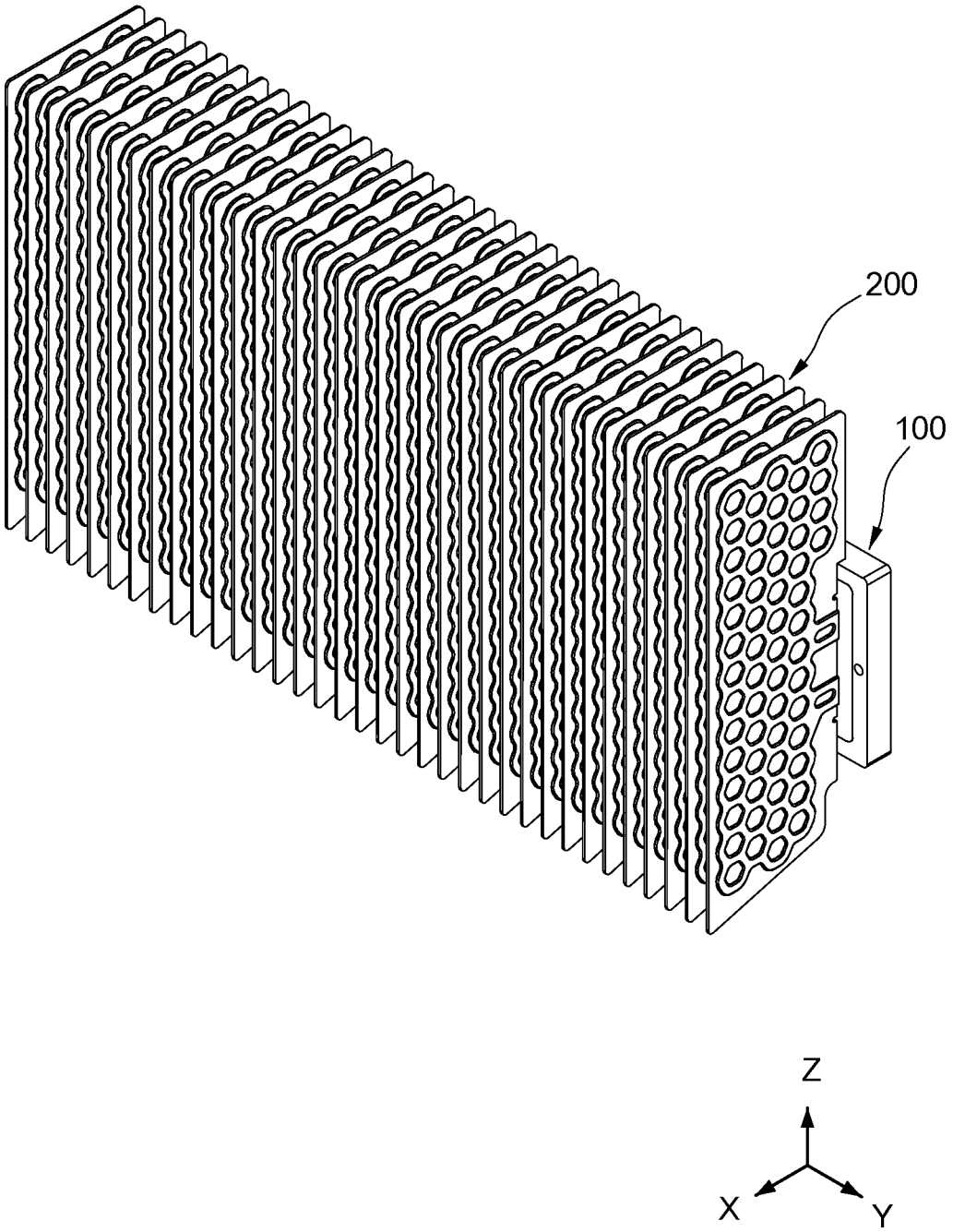
FIG. 1 is a perspective view showing a thermosyphon cooling device in a vertical (standing) status according to this disclosure.

FIG. 1 is a perspective view showing a thermosyphon cooling device in a vertical (standing) status according to this disclosure. According to an embodiment of this disclosure shown in FIG. 1, this disclosure is directed to a thermosyphon cooling device having a heat-exchange plate 100 and a plurality of roll-bond fins 200. Refer to a X-Y-Z Cartesian coordinates, the heat-exchange plate 100 is arranged parallelly to a Y-Z plane, the roll-bond fins 200 are arranged perpendicular to the Y-Z plane, the plurality of roll-bond fins 200 are upright arranged to be parallel to a Z-X plane, and the gravity is along a −Z direction.

Figure 2:
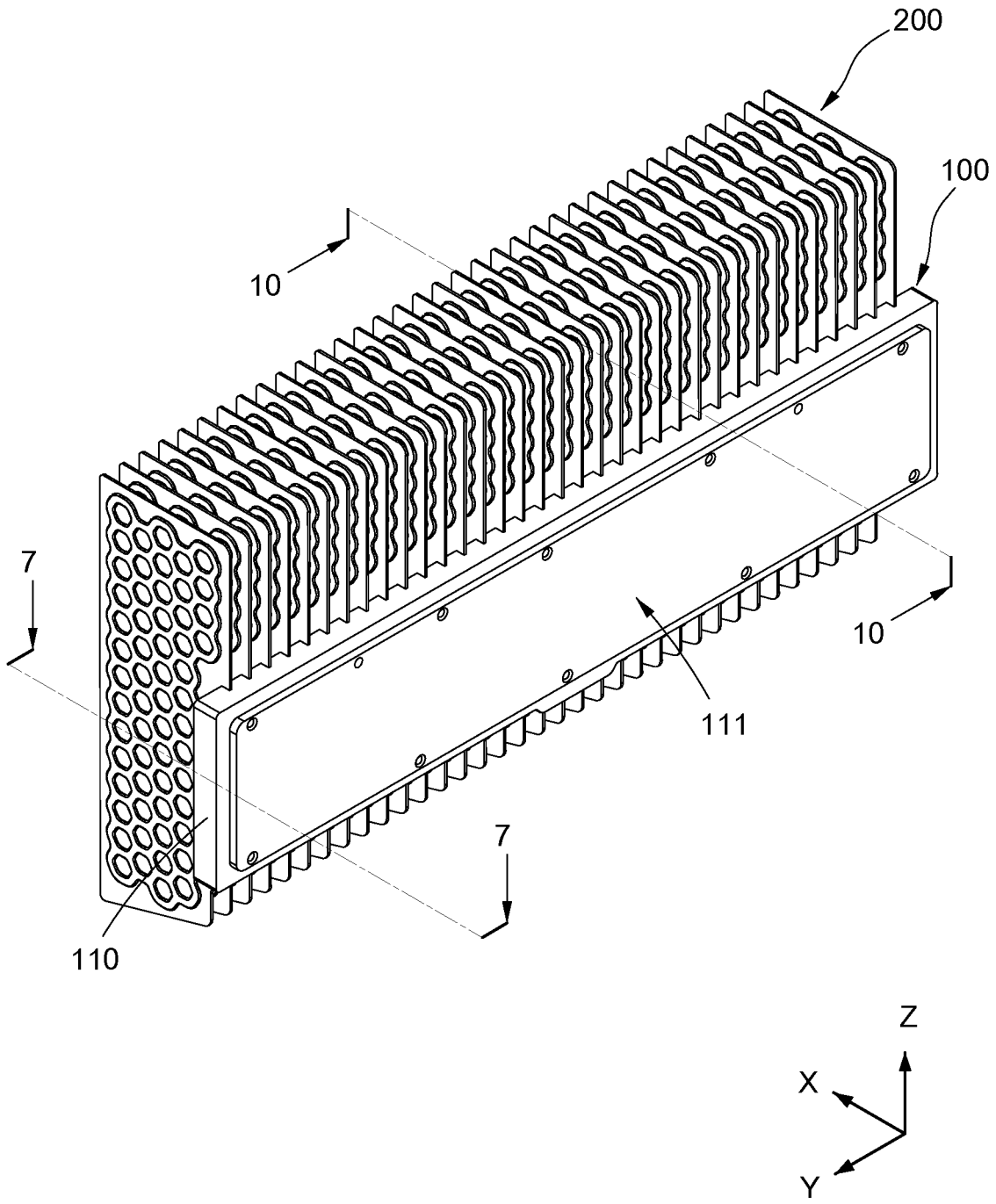
FIG. 2 is another perspective view in another direction showing the thermosyphon cooling device in the vertical status according to this disclosure.

FIG. 2 is another perspective view in another direction showing the thermosyphon cooling device in the vertical status according to this disclosure. According to FIG. 2, the heat-exchange plate 100 has a heat-exchange surface 111 at a side thereof, the heat-exchange surface 111 is disposed opposite to the plurality of roll-bond fins 200. The heat-exchange surface 111 is used for contacting a heat source (not be shown in figures) to absorb heat from the heat source. According to this embodiment, the heat-exchange plate 100 has a base case 110, and the heat-exchange surface 111 of the heat-exchange plate 100 is disposed on an external surface at a bottom of the base case 110.

Figure 3:
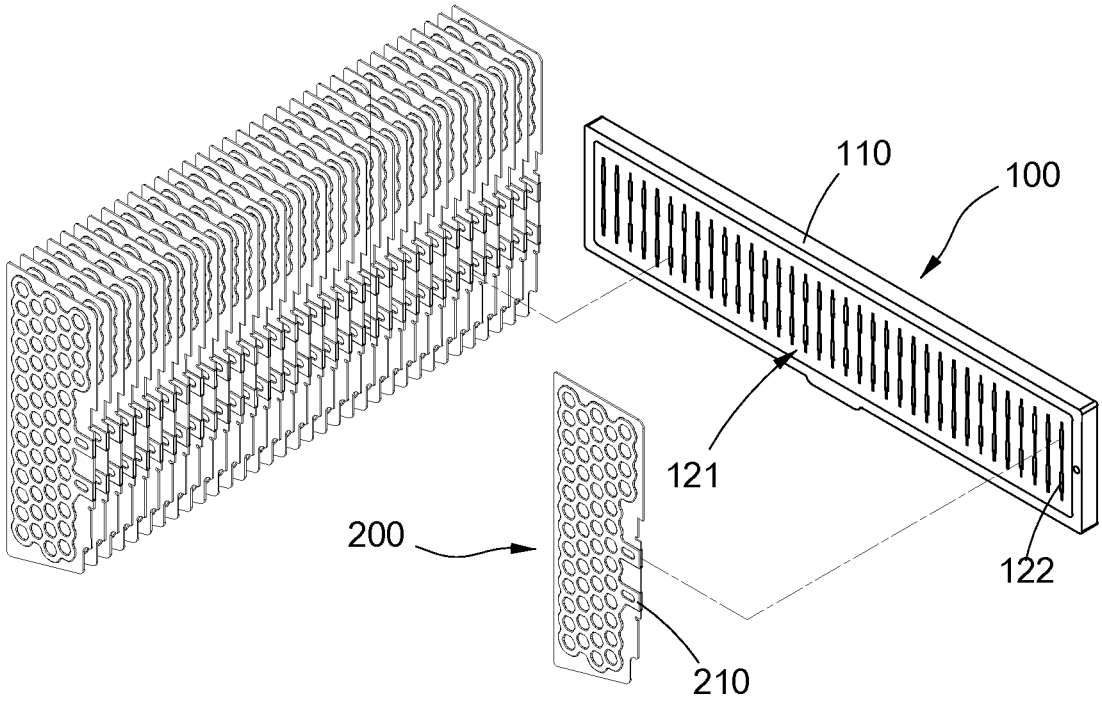
FIG. 3 is an exploded view of the thermosyphon cooling device according to this disclosure.

FIG. 3 is an exploded view of the thermosyphon cooling device according to this disclosure. Refer to FIGS. 2 and 3, the heat-exchange plate 100 has a top surface 121 at another side thereof opposite to the heat-exchange surface 111. That is, the top surface 121 is opposite to the external surface at the bottom of the base case 110 where the heat-exchange surface 111 disposed thereon.

Refer to FIG. 3, each of the roll-bond fins 200 is upright arranged on the of the heat-exchange plate 100. The heat-exchange plate 100 has a plurality of insertion holes 122 corresponding to the plurality of the roll-bond fins 200, and the plurality of roll-bond fins 200 are respectively inserted in the plurality of insertion holes 122 corresponding thereto. Each of the roll-bond fins 200 has at least two coupling tubes 210. The two coupling tubes 210 of each of the roll-bond fins 200 are inserted in the insertion holes 122 correspondingly, and can be further welded to be fixed.

Figure 4:
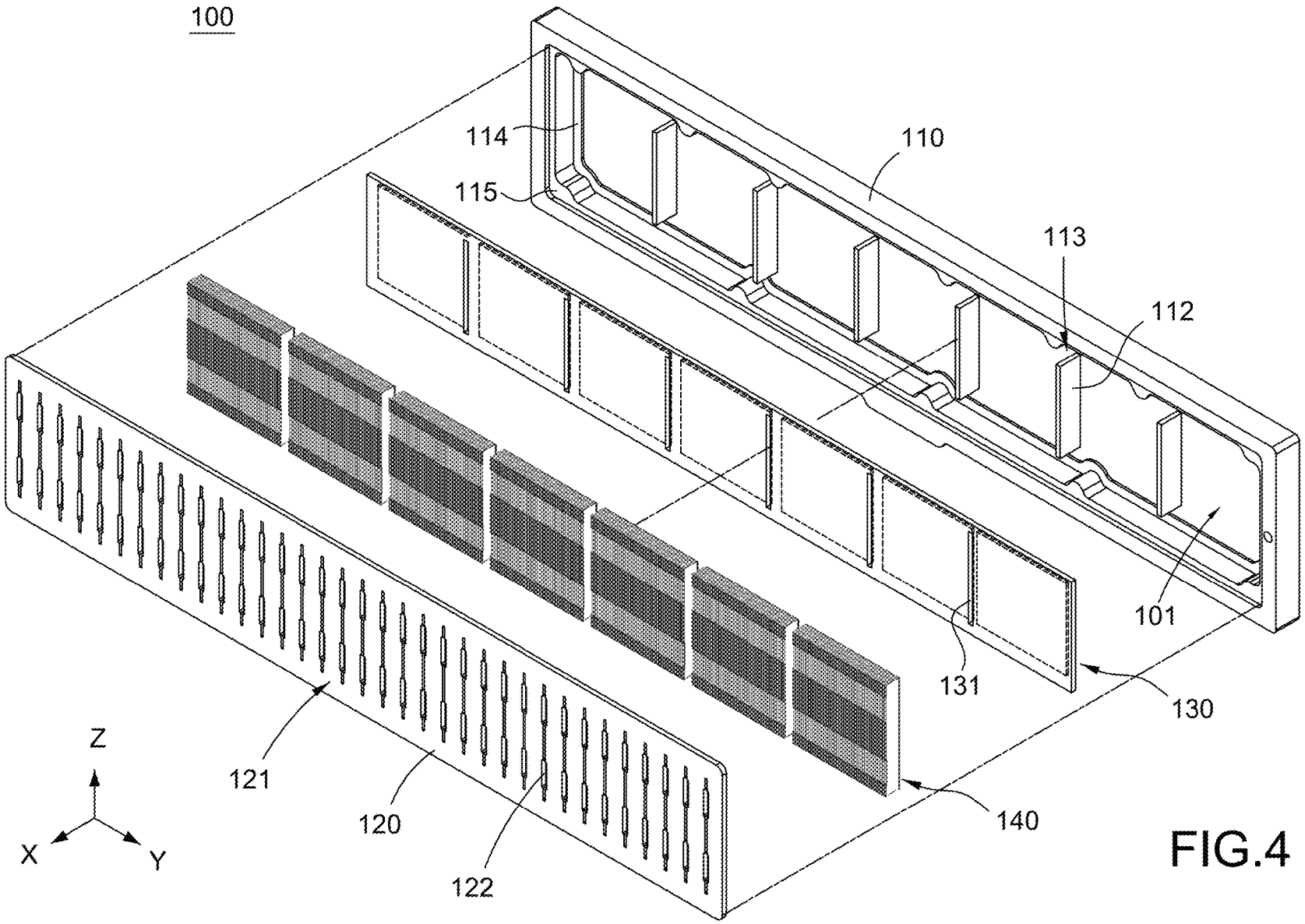
FIG. 4 is an exploded view of a heat-exchange plate belonging to the thermosyphon cooling device according to this disclosure.

FIG. 4 is an exploded view of a heat-exchange plate belonging to the thermosyphon cooling device according to this disclosure. Refer to FIG. 4, an evaporation chamber 101 enclosed by the base case 110 is defined in the heat-exchange plate 100. A plurality of partitions 112 are arranged in the evaporation chamber 101 so as to separate the evaporation chamber 101 into a plurality of spaces. In general, the, the heat source has multiple hot points, and heating power at various heating points are not uniform. The thermosyphon cooling device according to this disclosure has the partitions 112 to separate the heat-exchange plate 100, thereby avoiding mutual influences to heat exchange efficiency of the adjacent hot points to the heat-exchange plate 100. The partitions 112 are upright arranged on an internal bottom surface of the base case 110, and a gap 113 is defined between each of the partitions 112 and an internal lateral surface of the base case 110, so that the plurality of spaces defined by the plurality of partitions 112 can communicate with each other. A first stair portion 114 and a second stair portion 115 are arranged in the base case 110. The first stair portion 114 is arranged adjacently to a periphery of a bottom of the base case 110, and the second stair portion 115 is arranged adjacently to an inner edge of an opening of the base case 110. A capillary structure 130 is attached on an internal surface of the evaporation chamber 101, and arranged in the base case 110. The capillary structure 130 is attached on the internal bottom surface of the base case 110, and the capillary structure 130 has a plurality of through openings 131 corresponding to the plurality of partitions 112. The through opening 131 allows the partitions 112 on the internal bottom surface of the base case 110 to penetrate the capillary structure 130. A plurality of inner fin assemblies 140 are arranged in the heat-exchange plate 100, and the inner fin assemblies 140 are disposed in the spaces in the evaporation chamber 101 separated by the partitions 112, respectively.

Refer to FIG. 4, the heat-exchange plate 100 further has a top cover 120. The base case 110 has an opened top and the top cover 120 covers the top of the base case 110 to close the base case 110, the base case 110 is fixed with the top cover 120 by welding. The top surface 121 of the heat-exchange plate 100 is located outside the top cover 120, the plurality of insertion holes 122 are arranged on the top cover 120 of the heat-exchange plate 100.

Figure 5:
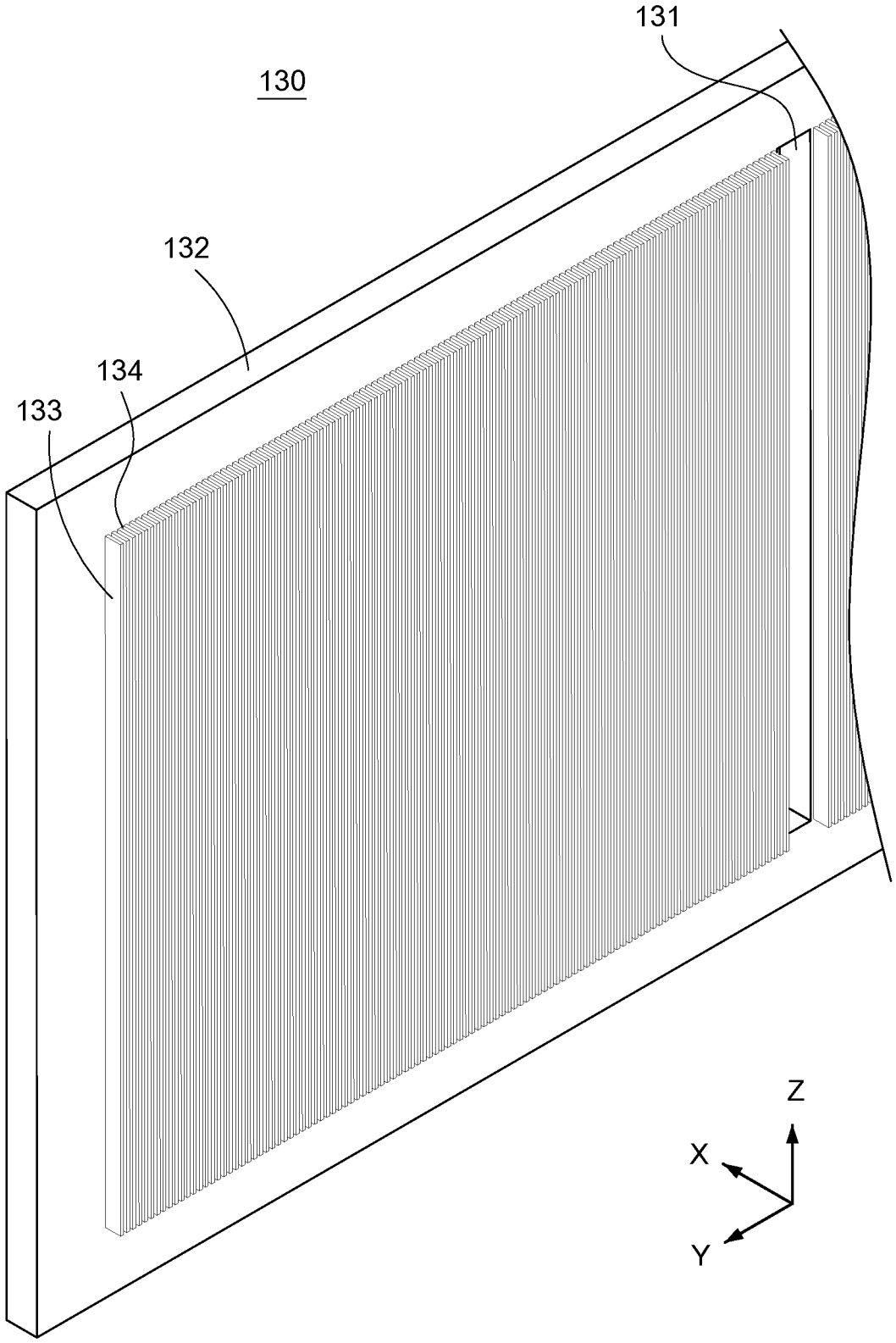
FIG. 5 is a perspective view in another direction showing a portion of the capillary structure.

FIG. 5 is a perspective view in another direction showing a portion of the capillary structure. As shown in FIG. 5, the capillary structure 130 has a substrate 132, the substrate 132 is penetrated by the through openings 131. A plurality of micro fins 133 are upright arranged on one surface on the substrate 132, and the micro fins 133 are disposed closely at intervals so as to from a plurality of capillary grooves 134. Each of the capillary grooves 134 is disposed between two of the micro fins 133 adjacent to each other. The micro fins 133 are disposed parallelly to the X-Z plane, and the capillary grooves 134 defined between the micro fins 133 are extended parallelly to Z direction, respectively.

Figure 6:
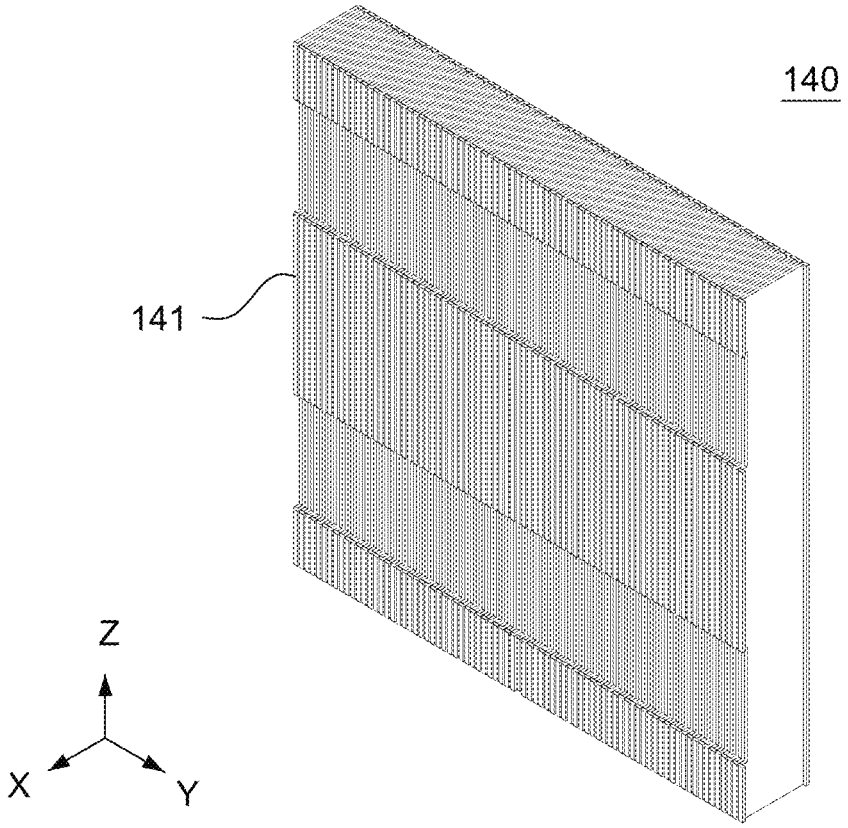
FIG. 6 is a perspective view showing single inner fin assembly.

FIG. 6 is a perspective view showing single inner fin assembly. As shown in FIG. 6, the inner fin assembly 140 has a plurality of inner fins 141 disposed at intervals. The inner fins 141 are disposed parallelly to the Z-X plane.

Figure 7:
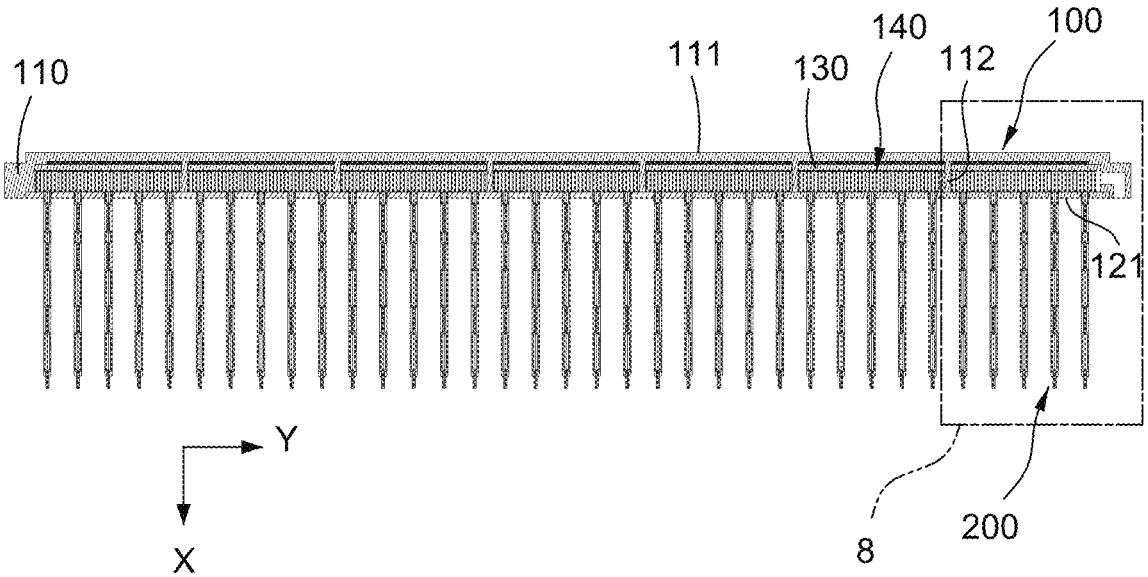
FIG. 7 is a cross-sectional view of the thermosyphon cooling device according to this disclosure on a 7-7 cross-section marked in FIG. 2.

FIG. 7 is a cross-sectional view of the thermosyphon cooling device according to this disclosure on a 7-7 cross-section marked in FIG. 2. The capillary structure 130 is disposed at the bottom of the base case 110 corresponding to the heat-exchange surface 111 of the heat-exchange plate 100, and the plurality of inner fin assemblies 140 are stacked on the capillary structure 130.

Figure 8:
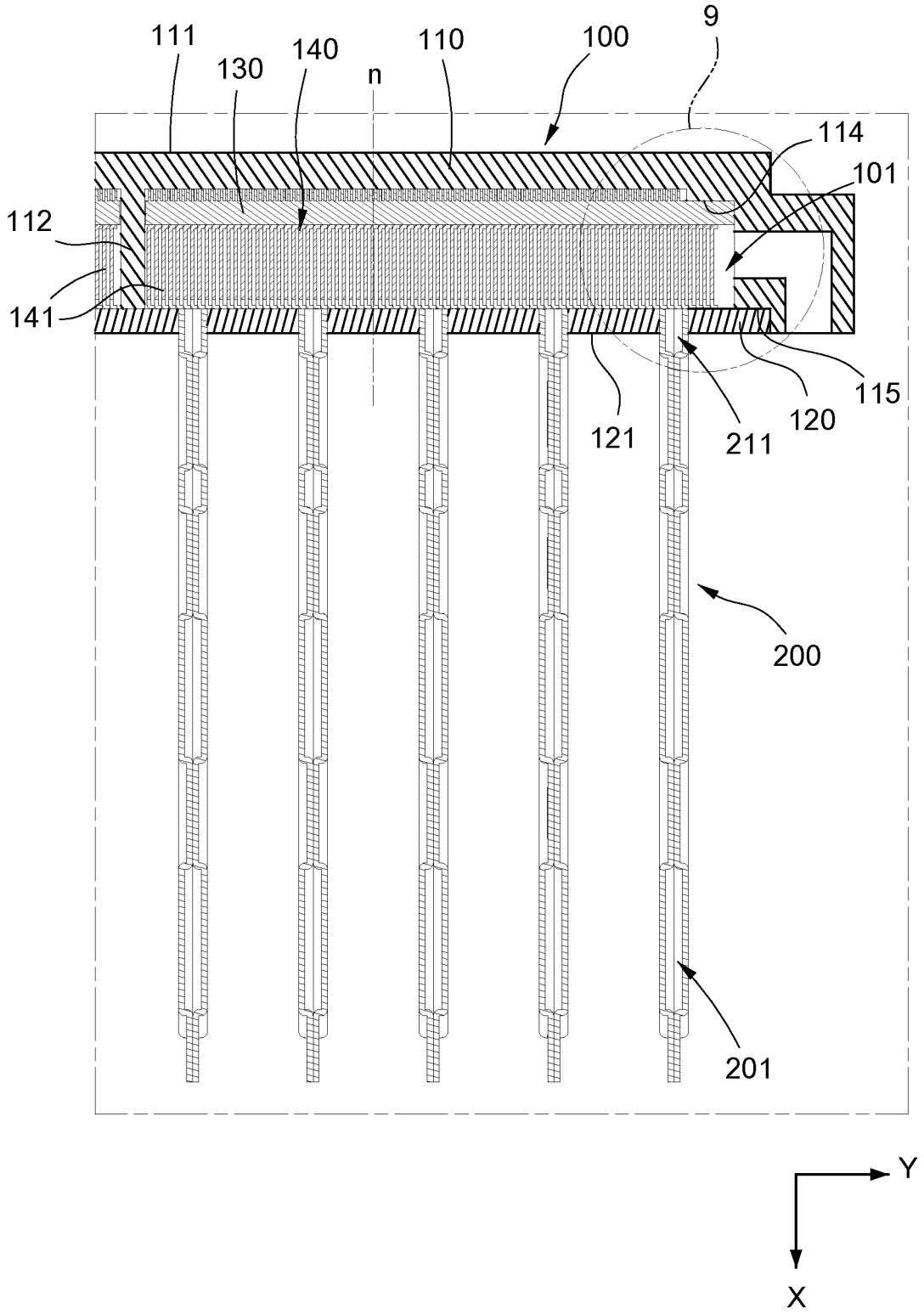
FIG. 8 is an enlarged view of a portion 8 marked in FIG. 7.

FIG. 8 is an enlarged view of a portion 8 marked in FIG. 7. Refer to FIGS. 7 and 8, the partitions 112 are extended from an inner side of the base case 110 and a top of each of the partitions 112 is fixed to the inner side of the top cover 120. The partitions 112 are connected to the internal bottom surface of the base case 110 and the inner side of the top cover 120. In other words, the partitions 112 are extended from the internal bottom surface of the base cases 110 to abut against the top cover 120. Each of the plurality of inner fins 141 is disposed parallelly to a normal line n of the heat-exchange plate 100.

Figure 9:
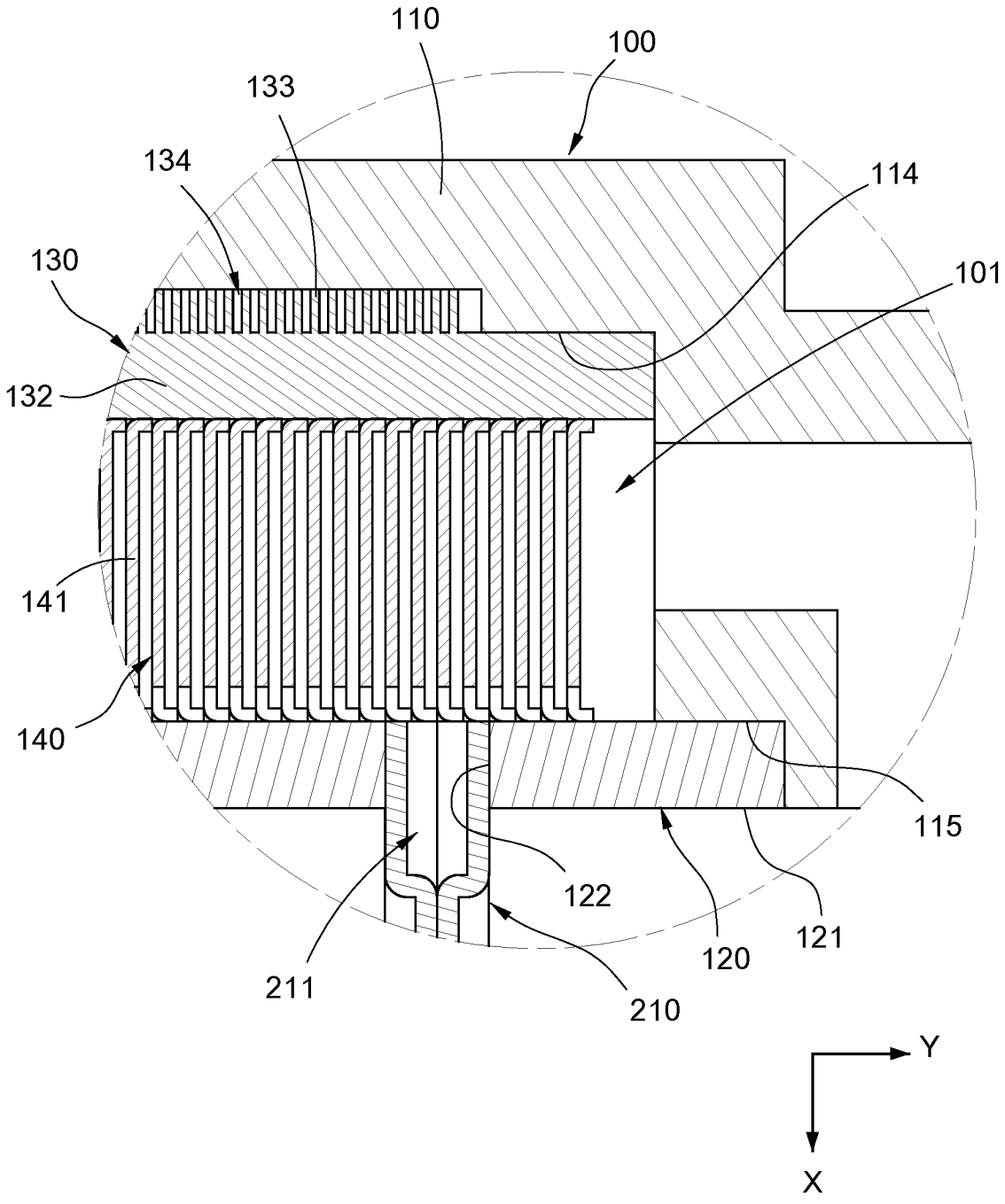
FIG. 9 is an enlarged view of a circled portion 9 marked in FIG. 8.

FIG. 9 is an enlarged view of a circled portion 9 marked in FIG. 8. Refer to FIGS. 8 and 9, a periphery of the capillary structure 130 abuts against the first stair portion 114. A periphery of the top cover 120 abuts against the second stair portion 115, so that the top surface 121 on the top cover 120 is combined with an external surface of the base case 110 to form a flat plane. The plurality of inner fin assemblies 140 are disposed between the top cover 120 and the capillary structure 130.

Refer to FIGS. 8 and 9 again, a periphery of the substrate 132 of the capillary structure 130 abuts against the first stair portion 114 to separate the substrate 132 from an inner side of the bottom of the base case 110. The plurality of capillary grooves 134 are disposed between the substrate 132 and the bottom of the base case 110, and the inner fin assemblies 140 and the capillary grooves 134 are disposed on two surfaces on the substrate 132 opposite to each other.

Refer to FIGS. 8 and 9, illustrating the plurality of roll-bond fins 200 having structures substantially the same as each other, only one of the roll-bond fins 200 is taken as an example in following paragraph for describing the structure. The roll-bond fin 200 is a hollow fin, a condensing chamber 201 is defined in the roll-bond fin 200. The condensing chamber 201 of the roll-bond fin 200 communicates with outside through the coupling tube 210, and an overflow opening 211 is formed in the coupling tube 210. When the roll-bond fin 200 is inserted in to connected to the heat-exchange plate 100, the condensing chamber 201 communicates to the insertion hole 122 of the heat-exchange plate 100 inserted by the coupling tube 210 through the overflow opening 211 in the coupling tube 210, so that the condensing chamber 201 communicates with the evaporation chamber 101 through the overflow opening 211. According to this embodiment, the roll-bond fin 200 has two overflow openings 211, but scopes of this disclosure should not be limited to the embodiment. The inner fin assemblies 140 are disposed between the overflow openings 211 and the capillary structure 130.

Figure 10:
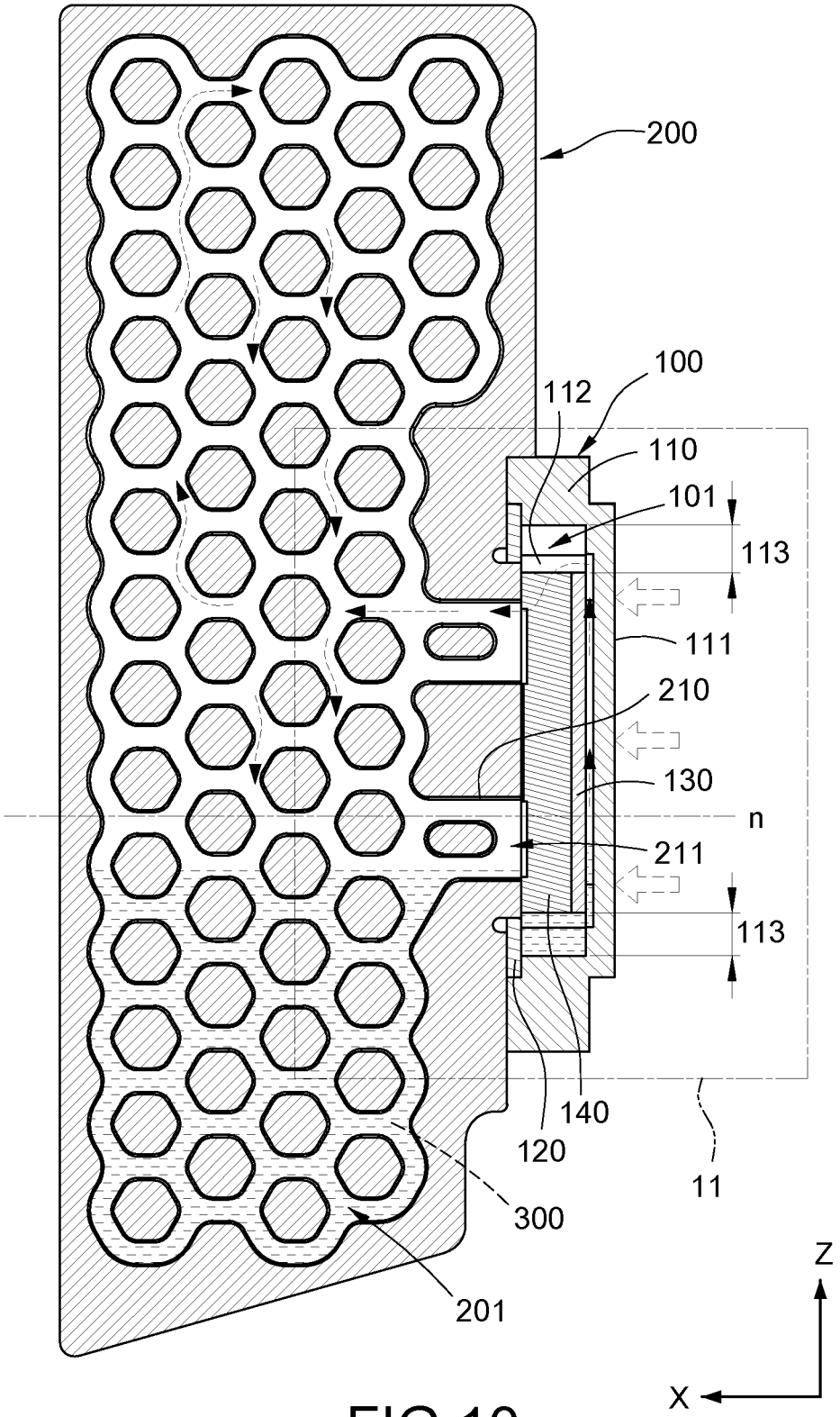
FIG. 10 is a cross-sectional view of the thermosyphon cooling device in the vertical status according to this disclosure on a 10-10 cross-section marked in FIG. 2.
Figure 11:
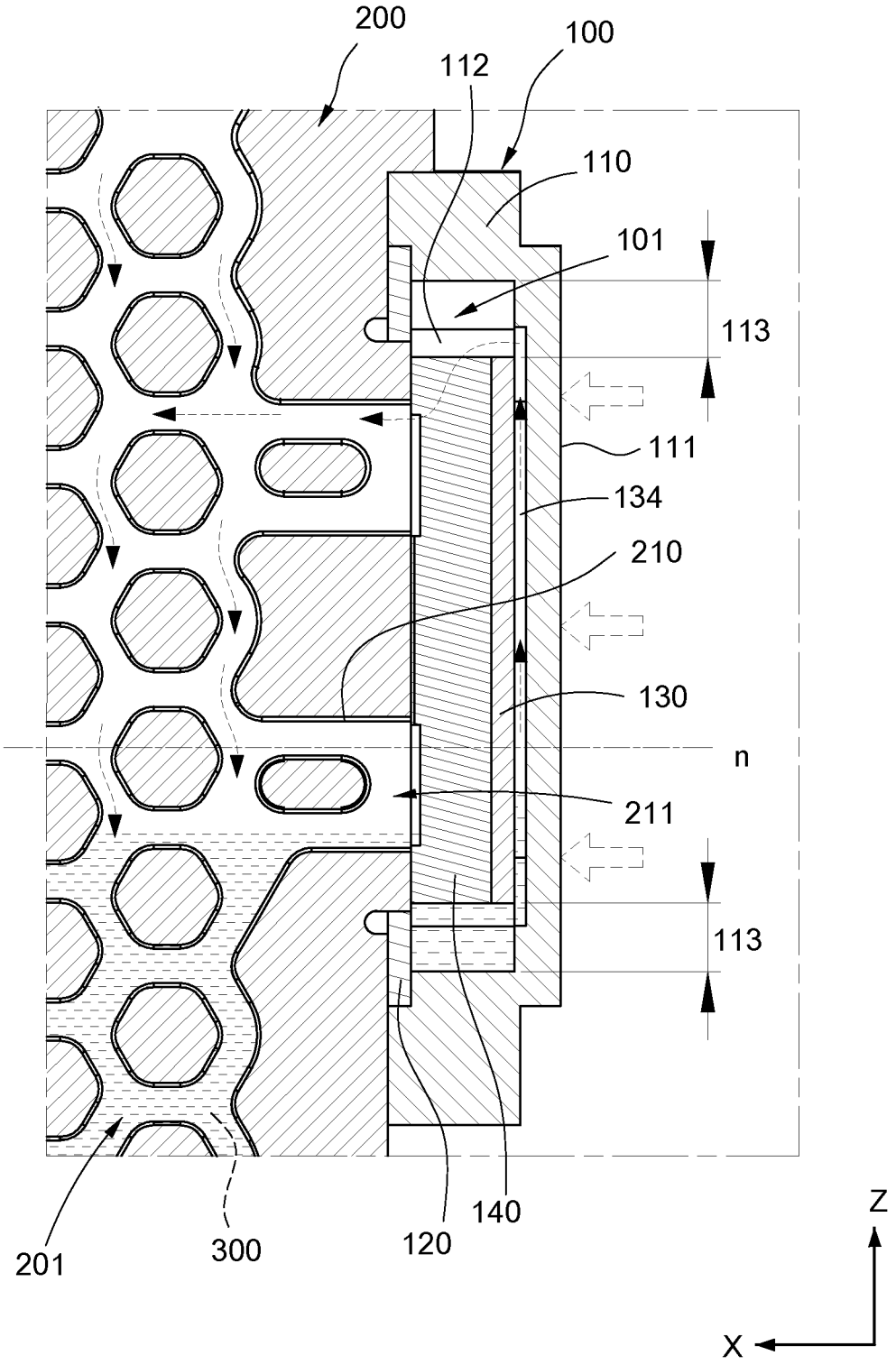
FIG. 11 is an enlarged view of a portion 11 marked in the exploded view of FIG. 10.

Refer to FIGS. 10 and 11, FIG. 10 is a cross-sectional view of the thermosyphon cooling device in the vertical status according to this disclosure on a 10-10 cross-section marked in FIG. 2 along −Y direction, and FIG. 11 is an enlarged view of a portion 11 marked in the exploded view of FIG. 10. When the thermosyphon cooling device according to this disclosure is operated in a vertical (standing) status, namely that the heat source is disposed on the Y-Z and the heat-exchange surface 111 is attached on the heat source, the condensing chamber 201 is extended along a direction of the normal line n of the heat-exchange plate 100 to be overlapped with a projection of at least one of the overflow openings 211 or to cross at least one of the overflow openings 211, and the condensing chamber 201 is extended along the direction perpendicular to the normal line n to cross at least one of the overflow openings 211. The overflow openings 211 crossed by the condensing chambers 201 in each of the roll-bond fins 200 can be the same one or different two of the overflow openings 211. The condensing chamber 201 is filled with a working fluid 300, the working fluid 300 contains both of gas and liquid phases, most of the working fluid 300 in liquid phase is stored in a portion of the condensing chamber 201 below the overflow opening 211, another part of the working fluid 300 in liquid phase working fluid 300 is stored in the evaporation chamber 101. The working fluid 300 in liquid phase contained in the evaporation chamber 101 is absorbed by the capillary structure 130 and contained in the capillary grooves 134 to flow upward along the Z direction and cover a portion of an inner wall of the base case 110 corresponding to the heat-exchange surface 111, thereby absorbing heat from the heat source through the heat-exchange surface 111. The working fluid 300 is vaporized after absorbing heat, and the inner fin assemblies 140 are capable of guiding the vaporized working fluid 300 to flow into the condensing chamber 201 along the X direction. The vaporized working fluid 300 flows into the condensing chamber 201 to be condensed in a top of the condensing chamber 201 and then drops to be gathered in the portion of the condensing chamber 201 below the overflow opening 211. The working fluid 300 in liquid phase accumulated until a level thereof rises to the overflow opening 211, and then the working fluid 300 in liquid phase overflows into the evaporation chamber 101 through the overflow opening 211 for next cycling.

Figure 12:
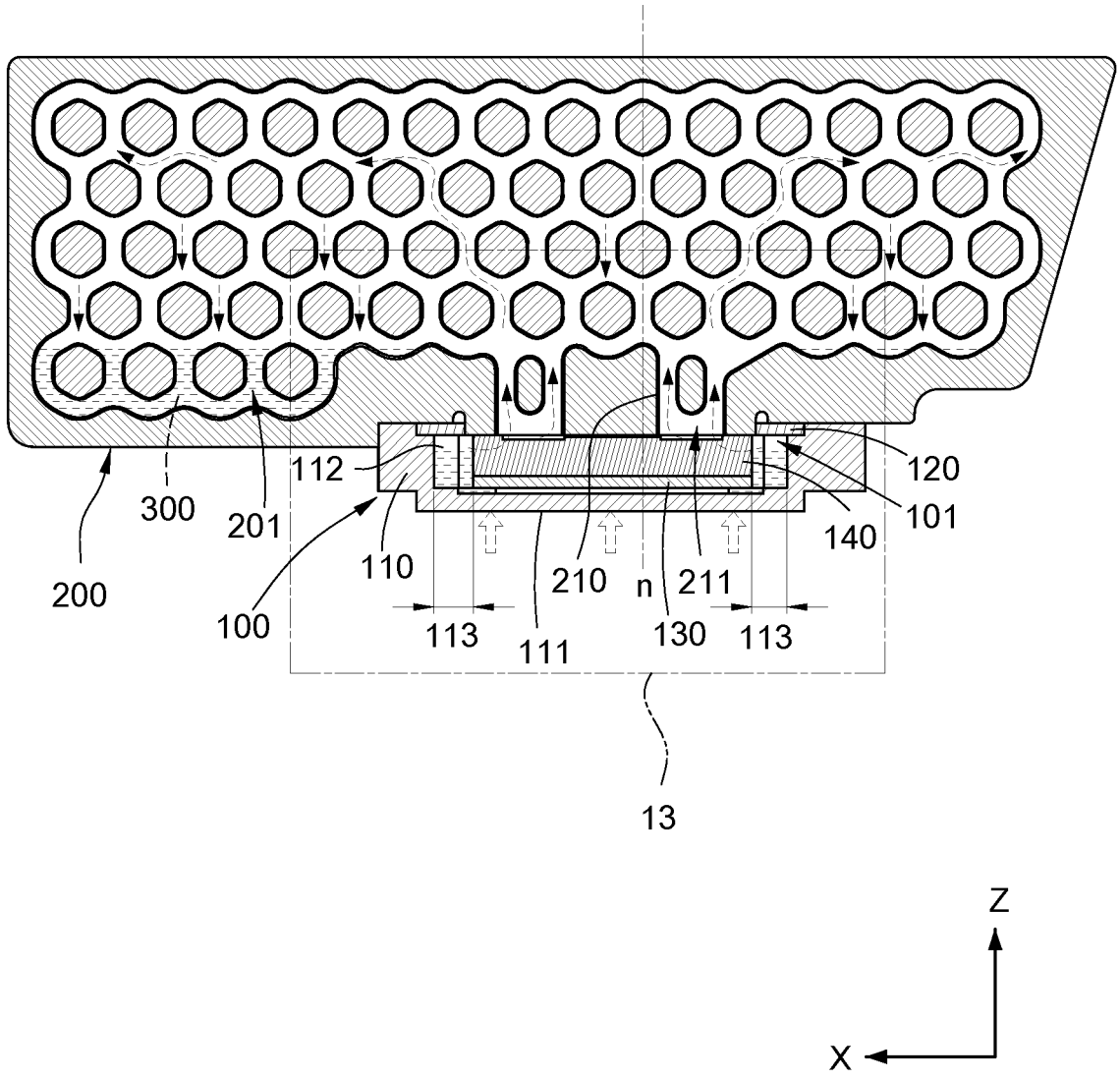
FIG. 12 is a cross-sectional view of the thermosyphon cooling device in a horizontal status according to this disclosure on a 10-10 cross-section marked in FIG. 2.
Figure 13:
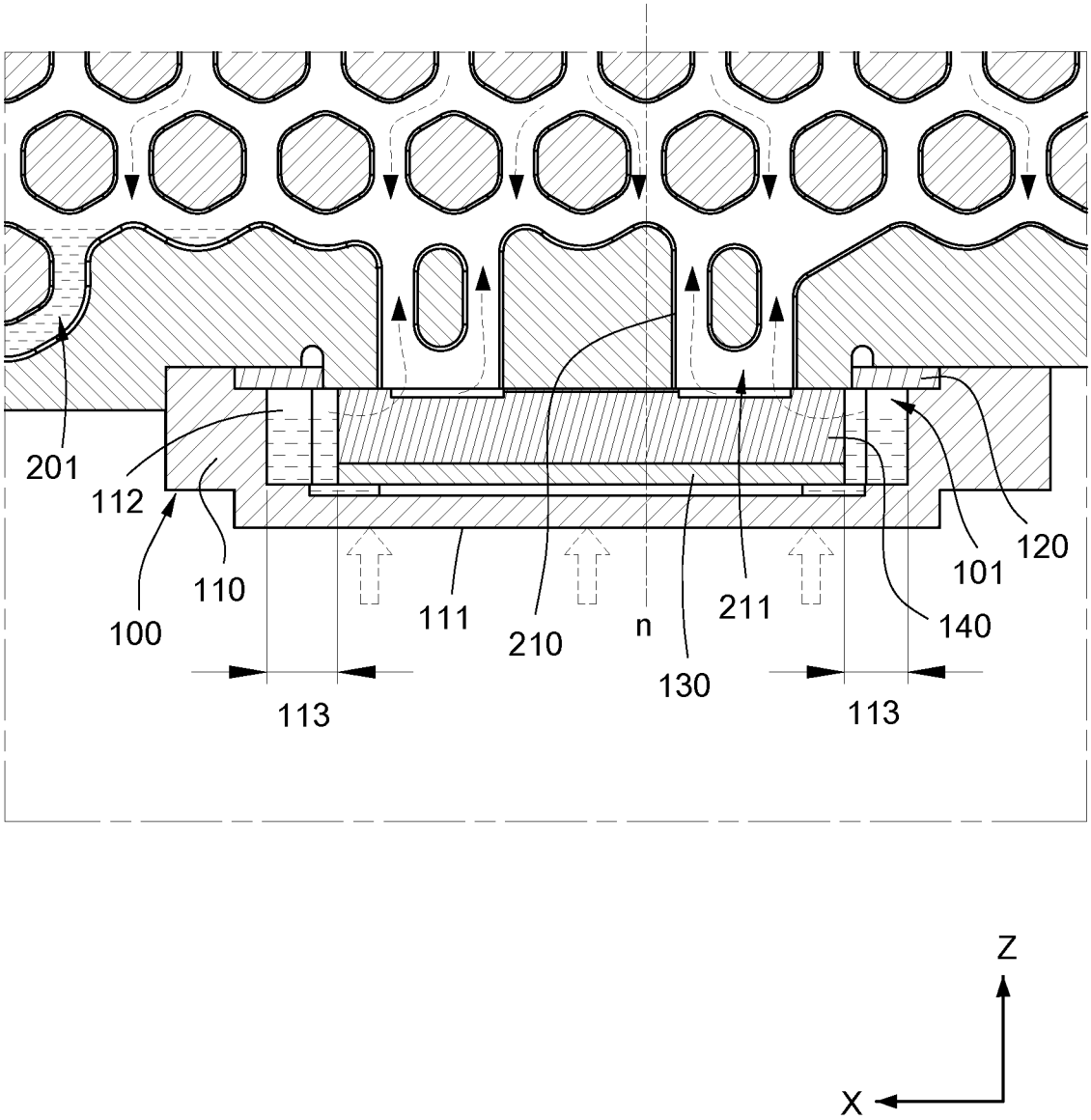
FIG. 13 is an enlarged view of a portion 13 marked in the exploded view of FIG. 12.

Refer to FIGS. 12 and 13, FIG. 12 is a cross-sectional view of the thermosyphon cooling device in a horizontal status according to this disclosure on a 10-10 cross-section marked in FIG. 2 along −Y direction, and FIG. 13 is an enlarged view of a portion 13 marked in the exploded view of FIG. 12. When the thermosyphon cooling device is operated in the horizontal status, referring to the X-Y-Z Cartesian coordinates, the heat-exchange plate 100 is disposed parallelly to the Y-Z plane, namely that the heat source is overlapped with the Y-Z plane, the roll-bond fins 200 are disposed perpendicular to the Y-Z plane, and the roll-bond fins 200 are disposed parallel to the Z-X plane. The condensing chamber 201 is extended along the direction of the normal line n of the heat-exchange plate 100 to be overlapped with a projection of at least one of the overflow openings 211 or to cross at least one of the overflow openings 211, and the condensing chamber 201 is extended along a direction perpendicular to the normal line n of the heat-exchange plate 100 to cross at least one of the overflow openings 211. The overflow openings 211 crossed by the condensing chambers 201 of the roll-bond fin 200 can be the same one or different two of the openings 211. The condensing chamber 201 is filled with a working fluid 300, the working fluid 300 contains both of gas and liquid phases, most of the working fluid 300 in liquid phase is stored in a portion of the condensing chamber 201 below the overflow opening 211, another part of the working fluid 300 in liquid phase working fluid 300 is stored in the evaporation chamber 101. The portion of the inner wall of the base case 110 corresponding to the heat-exchange surface 111 is covered by the working fluid 300 in liquid phase contained in the evaporation chamber 101, thereby absorbing heat from the heat source through the heat-exchange surface 111. The working fluid 300 is vaporized after absorbing heat, and the inner fin assemblies 140 are capable of guiding the vaporized working fluid 300 to flow into the condensing chamber 201. The vaporized working fluid 300 flows into the condensing chamber 201 to be condensed in a top of the condensing chamber 201 and then drops to be gathered in the portion of the condensing chamber 201 below the overflow opening 211. The working fluid 300 in liquid phase accumulated until a level thereof rises to the overflow opening 211, and then the working fluid 300 in liquid phase overflows into the evaporation chamber 101 through the overflow opening 211 for next cycling.

Refer to FIGS. 10 and 12, when the thermosyphon cooling device of this disclosure is operated either in the vertical status shown in FIG. 10 or in the horizontal status shown in FIG. 12, at least a portion of the condensing chamber 201 is located below the overflow opening 211. According to the thermosyphon cooling device of this disclosure, most of the working fluid 300 is stored in a portion of the condensing chamber 201 below the overflow opening 211, and a volume of this portion for containing liquid is disposed corresponding to a demand of the working fluid 300. With this arrangement, an appropriate amount of working fluid 300 keeps overflowing into the evaporation chamber 101 to cover the portion of the inner wall of the base case 110 corresponding to the heat-exchange surface 111, thereby preventing the working fluid 300 in this portion from a low evaporation efficiency caused by being submerged in a deep level of the working fluid 300. Furthermore, drying out caused by an insufficient covering of the working fluid 300 in an operation of vertical status may be prevented by the capillary structure 130 corresponding to the heat exchange surface 111. Accordingly, the thermosyphon cooling device of this disclosure is suitable for both the operation of vertical status or an operation in horizontal status. Moreover, the gap 113 is disposed between each partition 112 and the internal lateral surface of the base case 110, so that the partition 112 may not block a diffusion of the working fluid 300 in evaporation chamber 101.

While this disclosure has been described by means of specific embodiments, numerous modifications and variations could be made thereto by those skilled in the art without departing from the scope and spirit of this disclosure set forth in the claims.

What is claimed is:

1. A thermosyphon cooling device, comprising:

a heat-exchange plate, comprising an evaporation chamber defined therein, a heat-exchange surface, a top surface opposite to the heat-exchange surface, and a capillary structure attached on an inner surface of the evaporation chamber and arranged corresponding to the heat-exchange surface; and a plurality of roll-bond fins, upright arranged on the top surface, each of the roll-bond fins comprising a condensing chamber communicating with the evaporation chamber defined therein, the condensing chamber communicating with the evaporation chamber through at least one overflow opening, and a working fluid filled in the condensing chamber, wherein the condensing chambered is extended along a direction of a normal line of the heat-exchange plate to be overlapped with a projection of the at least one overflow opening, and the condensing chamber is extended along the direction perpendicular to the normal line to cross the at least one overflow opening, wherein the working fluid in liquid phase is stored in a portion of the condensing chamber below the overflow opening;

wherein the vaporized working fluid flows into the condensing chamber to be condensed in a top of the condensing chamber and then drops to gathered in the portion of the condensing chamber below the overflow opening; and wherein the working fluid in liquid phase accumulated until a level thereof rises to the overflow opening, and then the working fluid in liquid phase overflows into the evaporation chamber through the overflow opening.

2. The thermosyphon cooling device according to claim 1, wherein the heat-exchange plate comprises a base case and a top cover closing the base case.

3. The thermosyphon cooling device according to claim 2, wherein the heat-exchange surface is disposed on the base case, and the top surface is disposed on the top cover.

4. The thermosyphon cooling device according to claim 2, wherein a plurality of partitions is arranged in the base case, and each of the partitions is connected to the base case and the top cover, respectively.

5. The thermosyphon cooling device according to claim 4, wherein at least one gap is defined between each of the partitions and an internal surface of the base case.

6. The thermosyphon cooling device according to claim 4, wherein the capillary structure comprises a plurality of through openings corresponding to the partitions, and the capillary structure is penetrated by the partitions through the through openings correspondingly.

7. The thermosyphon cooling device according to claim 2, wherein the top cover comprises a plurality of insertion holes, and the roll-bond fins are inserted in the insertion holes respectively.

8. The thermosyphon cooling device according to claim 7, wherein each of the roll-bond fins comprises a coupling tube, the coupling tube communicates with the condensing chamber of the roll-bond fin, and a plurality of coupling tubes of the roll-bond fins are inserted in the insertion holes respectively.

9. The thermosyphon cooling device according to claim 8, wherein the overflow opening of the roll-bond fin is disposed in the coupling tube of the roll-bond fin.

10. The thermosyphon cooling device according to claim 2, wherein the capillary structure is arranged in the base case.

11. The thermosyphon cooling device according to claim 10, wherein a plurality of inner fins is arranged in the base case, and the inner fins are disposed between a plurality of overflow openings and the capillary structure.

12. The thermosyphon cooling device according to claim 1, wherein a plurality of inner fins is arranged in the heat-exchange plate.

13. The thermosyphon cooling device according to claim 12, wherein the inner fins are disposed parallelly to the normal line of the heat-exchange plate.

14. The thermosyphon cooling device according to claim 1, wherein the capillary structure comprises a substrate, a plurality of micro fins is upright arranged on a surface of the substrate, the micro fins are disposed closely and spacedly to define a plurality of capillary grooves, and each of the capillary grooves is disposed between two of the micro fins adjacent to each other.

15. The thermosyphon cooling device according to claim 14, wherein the plurality of capillary grooves is defined between the substrate and a bottom of the base case.

16. The thermosyphon cooling device according to claim 14, wherein a plurality of inner fins is arranged in the base case, and the inner fins and the capillary groove are disposed on two surfaces of the substrate opposite to each other.

* * * * *